US010946410B2

(12) United States Patent
Wadkins

(10) Patent No.: US 10,946,410 B2
(45) **Date of Patent: *Mar. 16, 2021**

(54) PARTICULATE-INCORPORATING ATTACHMENT FOR A DROP SPREADER

(71) Applicant: Joe Dennis Wadkins, Las Vegas, NV (US)

(72) Inventor: Joe Dennis Wadkins, Las Vegas, NV (US)

( * ) Notice: Subject to any disclaimer, the term of this patent is extended or adjusted under 35 U.S.C. 154(b) by 3 days.

This patent is subject to a terminal disclaimer.

(21) Appl. No.: 16/378,540

(22) Filed: Apr. 8, 2019

(65) Prior Publication Data

US 2019/0232329 A1 Aug. 1, 2019

Related U.S. Application Data

(63) Continuation-in-part of application No. 15/464,315, filed on Mar. 20, 2017, now Pat. No. 10,252,288.

(51) Int. Cl.

| | |
|---|---|
| ***A46B 17/02*** | (2006.01) |
| ***B05C 11/02*** | (2006.01) |
| ***B05C 19/00*** | (2006.01) |
| ***E01C 19/20*** | (2006.01) |
| ***E01C 13/08*** | (2006.01) |
| ***E01C 19/48*** | (2006.01) |
| ***E01C 19/15*** | (2006.01) |
| *B05C 19/04* | (2006.01) |

(52) U.S. Cl.

CPC ..... *B05C 11/023* (2013.01); *B05C 19/008* (2013.01); *E01C 13/08* (2013.01); *E01C 19/15* (2013.01); *E01C 19/2005* (2013.01); *E01C 19/4873* (2013.01); *B05C 19/04* (2013.01); *E01C 19/4866* (2013.01)

(58) Field of Classification Search

CPC ..... B05C 19/008; B05C 19/04; B05C 11/023; B05C 11/021; E01C 19/20; E01C 13/08

See application file for complete search history.

(56) References Cited

U.S. PATENT DOCUMENTS

| | | | | |
|---|---|---|---|---|
| 8,376,250 | B2 | 2/2013 | Conner et al. | |
| 8,490,897 | B1 * | 7/2013 | Magnus | E01C 19/2005 222/242 |
| 2006/0006256 | A1 | 1/2006 | Smith et al. | |

* cited by examiner

*Primary Examiner* — Jennifer C Chiang
(74) *Attorney, Agent, or Firm* — Connie R. Masters

(57) ABSTRACT

A particulate-incorporating attachment for a drop spreader is provided that includes a two-portion mount bracket, an implement holder, and a rake/brush and optionally includes wheels. The bracket portions are connected to form a mount bracket over the rest brace of the drop spreader. The mount bracket mounts the implement holder, which supports the rake/brush in a suitable position to assist in the incorporation of infill material into the space between the grass tufts of synthetic turf or to assist in the incorporation of other dropped particulates into synthetic or natural turf or onto the ground.

19 Claims, 14 Drawing Sheets

PARTICULATE-INCORPORATING ATTACHMENT FOR A DROP SPREADER

CROSS-REFERENCE TO RELATED APPLICATIONS

This application is a continuation-in-part of co-pending U.S. patent application Ser. No. 15/464,315 filed on Mar. 20, 2017, which will issue on Apr. 9, 2019 as U.S. Pat. No. 10,252,288 and which is incorporated herein in its entirety.

FIELD OF INVENTION

This invention relates generally to manual outdoor turf equipment and, more particularly, to a particulate-incorporating attachment for a manual drop spreader suitable for use in incorporating particles dispensed by the drop spreader, particularly during the filling of synthetic turf spaces with infill material.

BACKGROUND

Replacing grass with artificial or synthetic turf provides several advantages, such as greatly reducing the need for lawn maintenance and eliminating the use of water for lawn irrigation. Synthetic turf is typically fabricated with an upward-facing synthetic green grass face formed by tufts of grass and a downward-facing backing or understructure that supports the synthetic tufts of the grass face. The grass tufts may include additional thatch tufts. Tuft spaces, which are disposed between the grass tufts, typically receive an infill material during installation of the synthetic turf.

To install the synthetic turf, the turf area is prepared, and then one or more sections of synthetic turf are joined to cover the turf area. In most installation, the final step is to apply the infill. The infill is used to support the grass filaments and tuffs, to add dimensional stability, to provide a more realistic appearance, and/or to increase safety for sports players using a turf sports field.

Different types of infill are available to meet the requirements of the particular installation. Silica sand may be used in low traffic areas. A rubber and sand mixture may be used on medium traffic areas and commercial installations. Particulate or pelletized rubber or "crumb rubber" (which may be derived from scrap, recycled vehicle tires) is often used for synthetic turf sports fields to provide shock absorption, to enhance traction, to add ballast, and to protect the players from injury. For example, sports organizations require the hardness of sports fields to be less than 200 Gmax, which is achieved by using pelletized rubber. Other infill combinations and variations are available, such as acrylic-coated silica sand, organic mineral infill, and various elastomer infills.

For large synthetic turf fields, such as sports fields, tractors may spread the infill and pull a rear-attached powered brushing or raking attachment to level the infill and to incorporate it into the spaces between the tufts. However, in lawns and other smaller areas a manually-powered drop spreader is commonly used to apply the infill material (typically 1-2 pounds per square foot) onto the turf. The infill material is placed inside the drop spreader bucket, the dispenser gauge is set appropriately, and multiple passes are made to achieve an even distribution. Between each pass the synthetic grass fibers are manually brushed with a stiff bristled industrial broom, carpet rake, power broom, or the like to incorporate the infill into the synthetic turf. The dispensing and brushing steps are repeated until the infill material is evenly spread and incorporated to the prescribed depth.

This standard method of infill installation is less than desirable, because of the time and labor required for each of the manual infill dispensing steps and the separate manual infill brushing steps. Accordingly, there is a need for a device and method of use that will reduce the time and labor required during incorporation of turf infill.

BRIEF SUMMARY OF THE INVENTION

The present invention is directed to a particulate-incorporating attachment for a manual drop spreader that includes a two-portion mount bracket with an appended or integral implement holder that supports a rake/brush. The mount bracket is manually attachable to a rearward rest brace of the drop spreader in a manner to support and position the rake/brush in a suitable position for incorporating the infill into the turf spaces of synthetic turf or otherwise incorporating dispensed particulates.

The mount bracket includes a proximal bracket portion and a distal bracket portion, which are joined together over the rearwardly and downwardly extending rest brace of the drop spreader. In some aspects of the invention, the rest brace fully supports the mount bracket; in other aspects of the invention the mount bracket is supported by both the rest brace and wheels attached to the mount bracket.

The mount bracket supports the attached or integrally-formed implement holder to hold it securely in a position suitable for raking or brushing the infill into the synthetic turf. In one aspect, the implement holder has a channel that is configured to receive the removable or non-removable rake/brush. In an additional aspect, the rake/brush is removably attached to the implement holder via bolts inserted through corresponding holes on the rake/brush and on the implement holder. In another aspect, the implement holder and rake/brush are formed integrally.

Also disclosed are methods of attaching the particulate-incorporating attachment to the drop spreader and methods of using the particulate-incorporating attachment for installation of infill into synthetic turf or for incorporation of other spreader-dispensed particulates.

In one aspect of the present invention, the two mount bracket portions are formed of C-shaped pieces.

In another aspect of the present invention, the two mount bracket portions are formed of L-shaped pieces.

In an additional aspect of the present invention, the mount bracket is configured with end members to receive a wheel assembly.

In a further aspect of the present invention, the implement holder channel may form a ninety-degree angle with the flat panel of the implement holder.

In another aspect of the present invention, the implement holder channel may form an angle with the flat panel of the implement holder that is greater than ninety degrees.

In a further aspect of the present invention, the implement holder may be less than half the height of the mount bracket portions.

In another aspect of the present invention, the implement holder may be substantially the height of the mount bracket portions.

In a further aspect of the present invention, the implement holder may be formed integrally with a portion of the mounting bracket.

In an additional aspect of the present invention, the brush/rake may be formed integrally with the implement holder.

In another aspect of the present invention, a set of wheels are attached at the opposing outer ends of the mount bracket to run upon the ground and support the particulate-incorporating attachment.

In a further aspect of the present invention, a shield is attached to the mount bracket, the implement holder, and/or the brush/rake to reduce overspray of the particulates onto the operator of the drop spreader.

An object of the present invention is to provide a particulate-incorporating attachment for a drop spreader that can be used to aid in incorporating infill into synthetic turf.

This and other objects, features, and advantages of the present invention will become more readily apparent from the attached drawings and from the detailed description of the preferred embodiments which follow.

BRIEF DESCRIPTION OF THE DRAWINGS

The preferred embodiments of the invention will hereinafter be described in conjunction with the appended drawings, provided to illustrate and not to limit the invention, where like designations denote like elements.

Like reference numerals refer to like parts throughout the several views of the drawings.

DETAILED DESCRIPTION OF THE INVENTION

Figure 1:
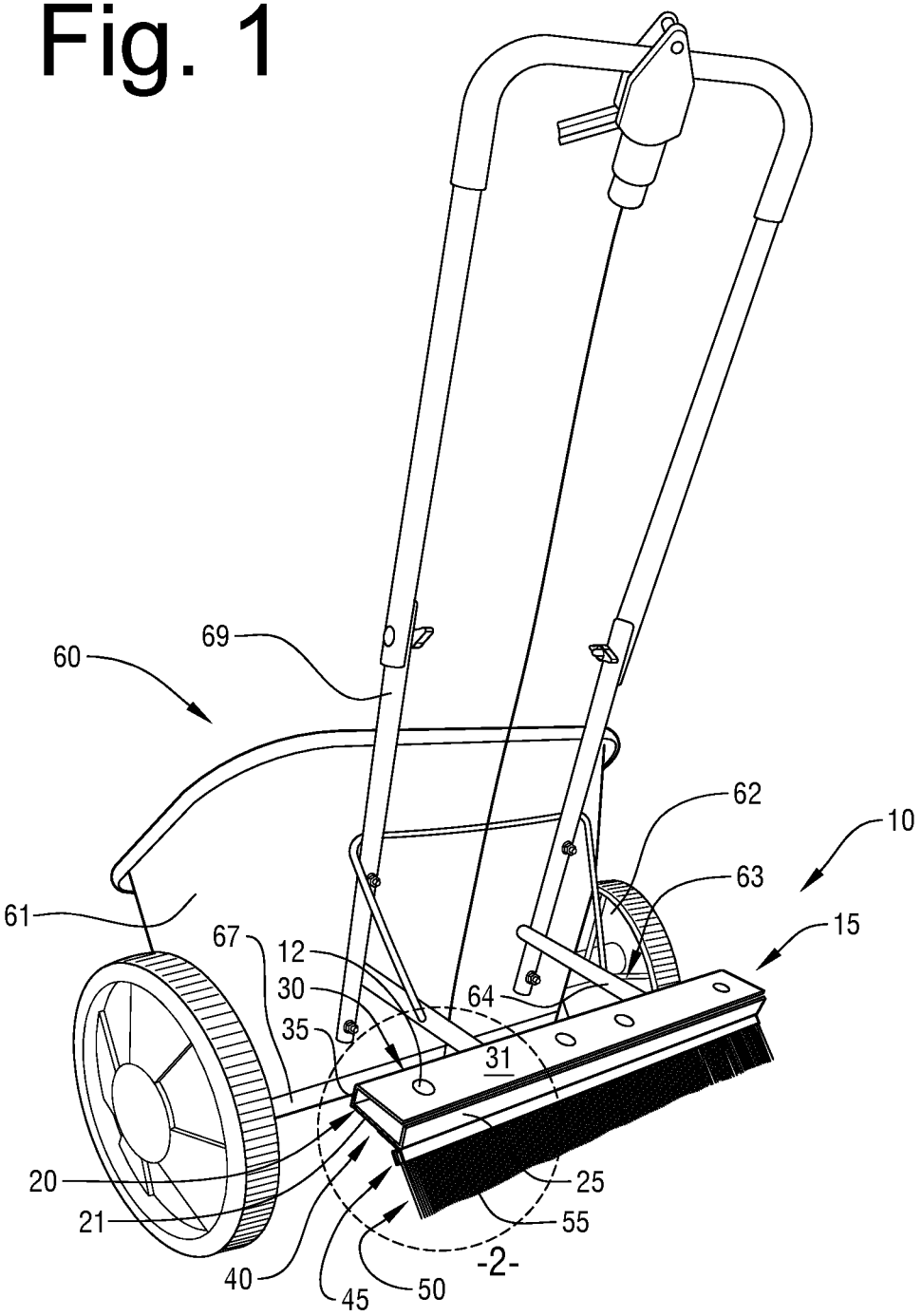
FIG. 1 is a perspective view of the first embodiment of the particulate-incorporating attachment of the present invention in its environment of use, which is attached to a manual drop spreader.

Shown throughout the figures, the present invention is directed toward a particulate-incorporating attachment 10 for a drop spreader 60 (which is typically human-powered, but can optionally be a pull-behind spreader) and methods of utilizing the particulate-incorporating attachment 10 to spread and/or incorporate infill into synthetic turf and/or to spread, smooth, or level other particulates dispensed by the drop spreader 60. The particulate-incorporating attachment 10 may suitably comprise a two-part mount bracket 15, a rake/brush 50, and an implement holder 40.

The mount bracket 15 mounts the rake/brush 50 at an appropriate angle and position for performing the functions of smoothing, leveling, spreading, integrating, and/or incorporating the spreader-dispensed particulates. The mount bracket 15 attaches around, and is supported by, the spreader's rest brace 63 (or for spreaders without a rest brace, a rest brace-like component that is attached at the back of the spreader to allow usage of the particulate-incorporating attachment). Typically, the rest brace 63 extends downwardly from the spreader handle 69 behind or rearward of the spreader bucket 61.

The two-portion mount bracket 15 comprises at least a distal panel 31, a proximal panel 21, an upper flange 35, a lower flange 25, and a means to connect the mount bracket 15 to or around the spreader rest brace 63. The upper flange 35 is configured with a right and left set of notch edges 37 that define right and left upper flange notches 36. The right and left sides of the spreader rest brace 63 are received into these right and left notches 36, respectively, and held there when the particulate-incorporating attachment 10 is in use. For purposes of description herein, the terms "proximal" and "distal" and derivatives thereof shall relate to the proximity to the rear of the bucket 61 of the drop spreader 60 when in use; the term "incorporating" and derivatives thereof shall include one or more of the functions of smoothing, leveling, spreading, integrating, or incorporating; and the terms "upper", "lower", "rear" or "rearward," "front" or "forward," "left," "right," "vertical", "horizontal", and derivatives thereof shall relate to the invention as oriented when in use by a user with the rake/brush 50 directed downward toward the synthetic grass, natural grass, or ground.

The two-portion mount bracket 15 comprises a proximal bracket portion 20 (which in the first embodiment comprises a proximal panel 21 and a lower flange 25) and a distal bracket portion 30 (which in the first embodiment comprises a distal panel 31 and an upper flange 35). The proximal bracket portion 20 and distal bracket portion 30 are manually connectable around the spreader's rest brace 63. Attached to, or formed integrally with, one of the two bracket portions 20, 30 is the implement holder 40, which secures the rake/brush 50 removably or non-removably to the mount bracket 15. The rake/brush 50 is supported only by the mount bracket 15 and implement holder 40 in the first embodiment, but is supported by the mount bracket 15, the implement holder 40, and the wheels 80 in the fourth embodiment.

The bracket portions 20, 30 of the mount bracket 15 are configured to be combined around the rest brace 63, which is rearward of the drop spreader bucket 61. Due to the positioning of the mount bracket 15 around the lower portion of the rear rest brace 63, the rake/brush 50 is positioned behind or rearward of the bottom opening 67 of the spreader bucket 61 and is carried forward behind the bucket 61 when the spreader wheels 62 turn propelled by manual power. Therefore, as the particulates are dispersed onto the grass by the normal action of the drop spreader 60, they are immediately brushed or raked into the grass and incorporated.

The mount bracket 15 and rake/brush 50 may be constructed and arranged in various suitable configurations that meet the present invention's requirements of using the spreader's rest brace 63 for supporting the mount bracket 15 and using the mount bracket 15 to hold or support the rake/brush 50 in the proper position to brush or rake spreader-dropped particulates along or into the synthetic grass (or, in other environments of use, the natural grass or the ground). To illustrate these suitable configurations, four exemplary embodiments with multiple aspects are presented.

Figure 2:
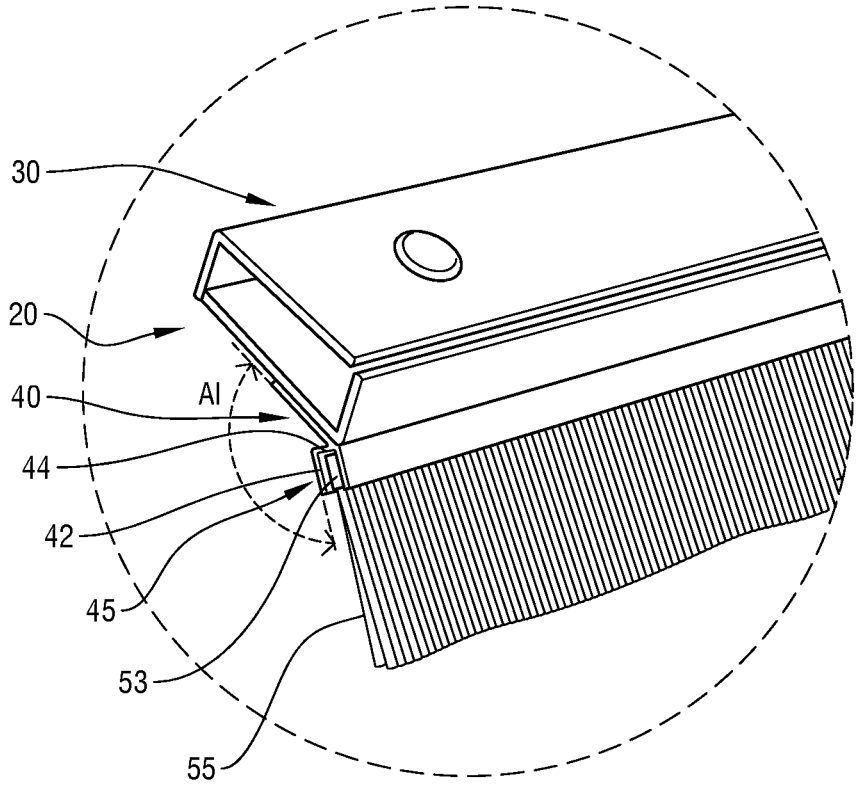
FIG. 2 is a detail view taken from circle -2- of FIG. 1 illustrating the mount bracket portions, implement holder, and rake/brush of the first embodiment of the present invention.

In the first exemplary embodiment, shown in FIGS. 1-2, the proximal bracket portion 20 and distal bracket portion 30 are both L-shaped, as can best be seen in the detail view of FIG. 2. The implement holder 40 is removably attached to the proximal bracket portion 20. The implement holder 40 includes a flat panel 49 and a channel 45 for permanently receiving a removable or non-removable rake/brush 50.

The distal bracket portion 30 comprises a distal bracket forward panel 31 and a distal bracket upper flange 35. The distal bracket upper flange 35 extends along the longitudinal length of the panel 31 at a substantially ninety-degree angle, together forming the L-shape. The distal bracket panel 31 is a flat metal plate configured with hole edges defining a set of holes 38 that correspond to holes 28 in the proximal bracket panel 21, which are used to connect the two bracket portions 20, 30.

Figure 4:
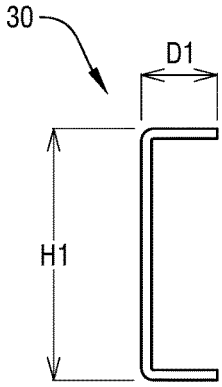
FIG. 4 is an end view of the distal bracket portion of the second embodiment of the present invention.
Figure 5:
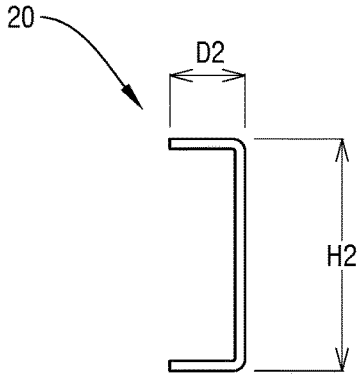
FIG. 5 is an end view of the proximal bracket portion of the second embodiment of the present invention.
Figure 8:
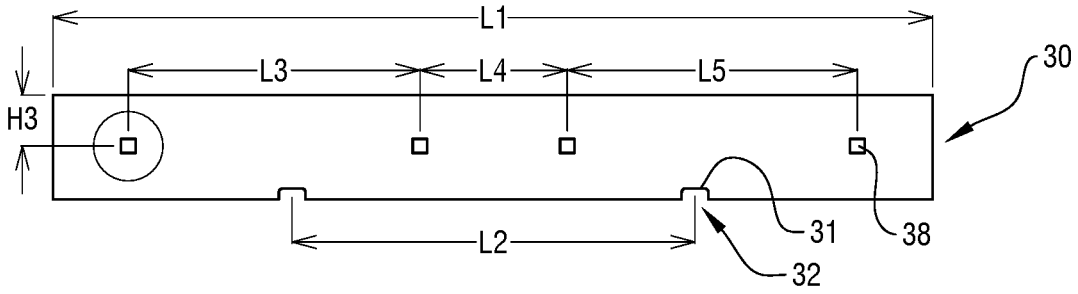
FIG. 8 is a front view of the distal bracket portion of the second embodiment of the present invention.
Figure 9:
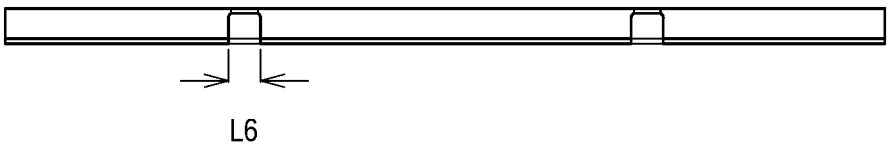
FIG. 9 is a top view of the distal bracket portion of the second embodiment of the present invention.

Though the distal bracket upper flange 35 may be formed separately and attached to the panel 31, preferably the flange 35 is formed integrally with the panel 31. Preferably, a single sheet of metal (a flat metal blank) is used that has a width (bend allowance+D1+H1, where D1 and H1 are shown in the illustration of the second embodiment of FIG. 4) suitable to form both the flange 35 and the panel 31 and that has a length (L1, shown in the illustration of the second embodiment of FIG. 8) suitable for use with the particular model of drop spreader 60 for which the attachment 10 is designed. In an aspect, the flange 35 may be formed by bending the metal blank at a substantially ninety-degree angle to create the flange 35 along one longitudinal side of the panel 31.

Before bending, the section of the metal blank that will form the distal bracket upper flange 35 is configured with two sets of distal bracket upper flange notch edges 37 that define the flange notches 36. The flange notches 36 are spaced and sized to accommodate the extending arms 64 of the rest brace 63. The flange 35 has a depth D1 (FIG. 4) that is approximately equal to or slightly smaller than the diameter of the rest brace arms 64 to allow the rest brace arms 64 and cross member 65 to be installed into the interior space of the two-part bracket and held securely or clamped by the action of the fasteners 12 between the proximal bracket portion 20 and the distal bracket portion 30.

The metal blank from which the distal bracket flange 35 and forward panel 31 are formed has a length L1 (FIG. 8) which is significantly greater than the distance between the rest brace extending arms 64, so that a portion of the distal bracket portion 30 extends on both the left and right sides beyond the rest brace extending arms 64 that are received within flange notches 36.

The proximal bracket portion 20 is formed and configured similarly to the distal bracket portion 30. It comprises a proximal bracket lower flange 25 that extends longitudinally at a substantially ninety-degree angle along the longitudinal length of a proximal bracket panel 21. The proximal bracket portion 20 is substantially the same length as the distal bracket portion 30 to which it is removably connectable. As with the distal bracket portion 30, in the proximal bracket portion 20 the flange 25 is preferably formed integrally with the panel 21 from a metal blank, though they may be formed separately and permanently joined. The bending of the bracket portions 20, 30 may be accomplished by using any of the known metal bending fabrication techniques to create the substantially ninety-degree angle between the flanges 25, 35 and panels 21, 31.

The proximal bracket portion 20 is configured with hole edges defining a set of holes 28 that correspond to the set of distal bracket holes 38. After insertion of the spreader rest brace 63 into the flange notches 36 (illustrated in FIG. 10, in the discussion of the second embodiment) the proximal bracket portion 20 is attached with fasteners 12, such as carriage bolts, to the distal bracket portion 30 via the aligned, corresponding sets of holes 28, 38 to form the completed mount bracket 15.

The implement holder 40 is a panel (preferably metal) extending substantially the length of the distal bracket portion 30 that attaches adjacent to the proximal bracket portion 20. (In another aspect, the implement holder 40 is optionally formed integrally with the proximal bracket portion 20.) The implement holder 40 may be attached to the outer side of the proximal bracket portion 20 before forming the completed mount bracket 15 or may be attached to the completed mount bracket 15.

In the aspect shown in FIGS. 1-3, 6, 11-12, and 15 the implement holder 40 includes a channel 45 for receiving the rake/brush 50. The channel 45 may have a base 44 (FIG. 2) and opposing extending arms 42 disposed at the longitudinal edges of the base 44. The base 44 and arms 42 are sized and shaped to accommodate the binding 53 of the rake/brush 53 and to hold it securely. The arms 42 may end in an inward projection 43 (FIG. 6) or may angle inward to hold the rake/brush 53 firmly in place while in use. In one aspect shown in FIGS. 1-2, the channel is attached at an angle A (A1 of FIG. 2) between the back of the channel and the panel of the implement holder, which is greater than ninety degrees. In another aspect shown in FIG. 6, the channel 45 is attached at an angle A (A2 of FIG. 6) at substantially ninety degrees. To allow the particulate-incorporating attachment 10 to be attached to varying brands and types of drop spreaders, the angle A between the channel 45 and the panel 21 may vary between 80 to 190 degrees.

Figure 3:
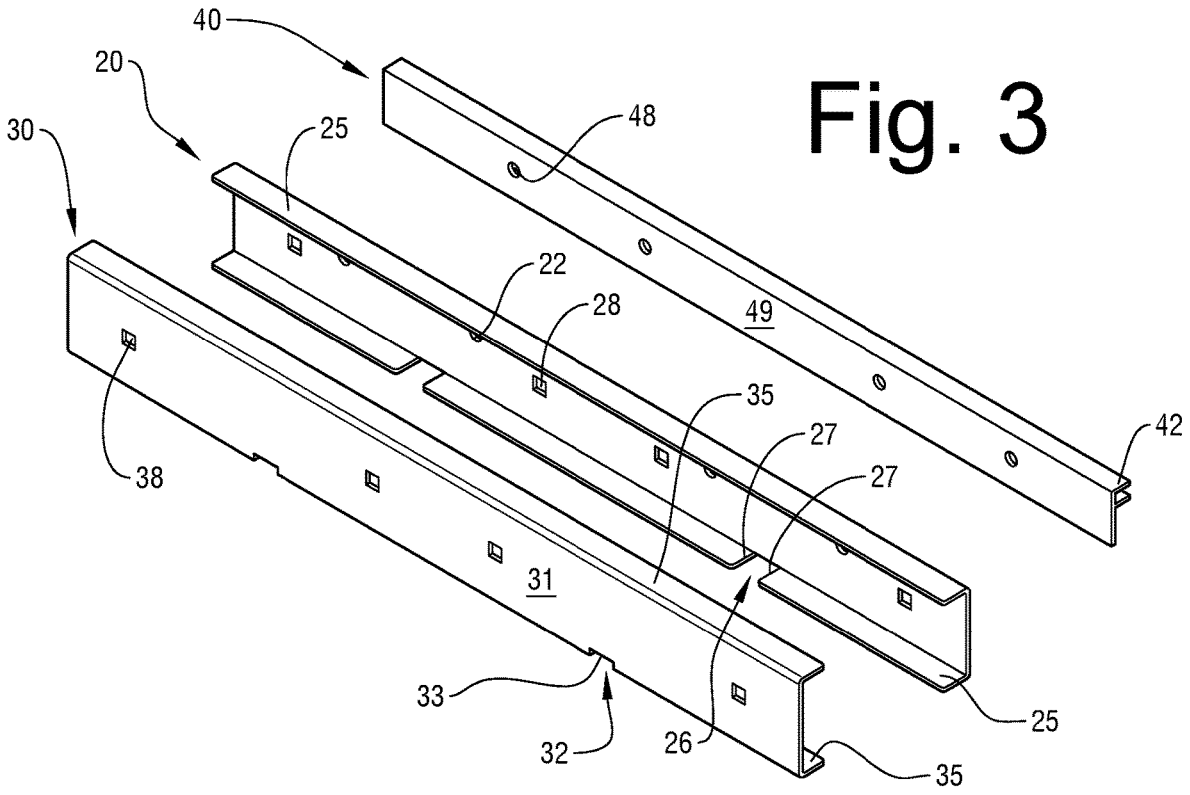
FIG. 3 is an exploded view of the two mount bracket portions and an aspect of the implement holder of the second embodiment of the present invention.

In one aspect of the invention seen in FIG. 3, the proximal bracket portion 20 includes bracket holes 22, and the implement holder 40 is attached to the proximal bracket portion 20 via implement holder holes 48 that correspond to bracket holes 22. The cutouts defining the implement holder holes 48 may be generally centered vertically within the vertical panel of the implement holder 40. The corresponding cutouts defining the bracket holes 22 are not centered vertically within the panel of the proximal bracket portion 20, but are generally centered on the downward facing half of the proximal bracket portion 20. (Note that the exploded view of FIG. 3 shows the pieces with the bottom of the brackets 20, 30 and implement holder upward, the opposite of the orientation of FIG. 1.) In these embodiments, the implement holder 40 is less than half the height of the proximal bracket portion 20 so is attached below the corresponding sets of holes 28, 38. However, in another preferred aspect of the invention shown in FIG. 12, the implement holder 40 has a greater height and is configured with holes 48 that correspond to the sets of holes 28, 38 of the two bracket portions, so holes 28, 38, 48 are aligned and receive fasteners 12, thereby reducing the work of assembly of the attachment 10.

Figure 11:
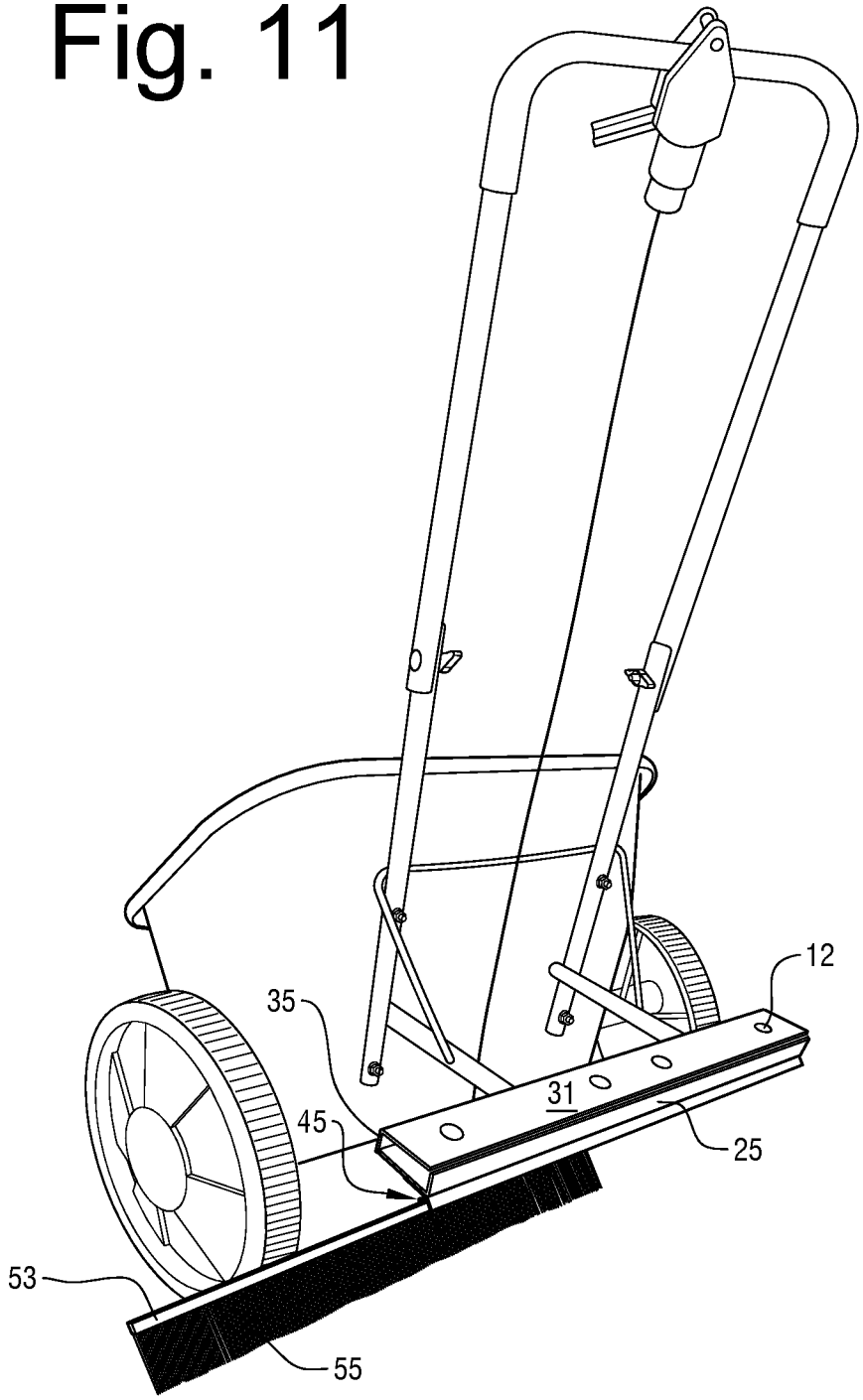
FIG. 11 is a perspective view illustrating insertion of the rake/brush into the implement-receiving channel of the implement holder, shown with the mounting bracket of the first embodiment of the present invention.
Figure 12:
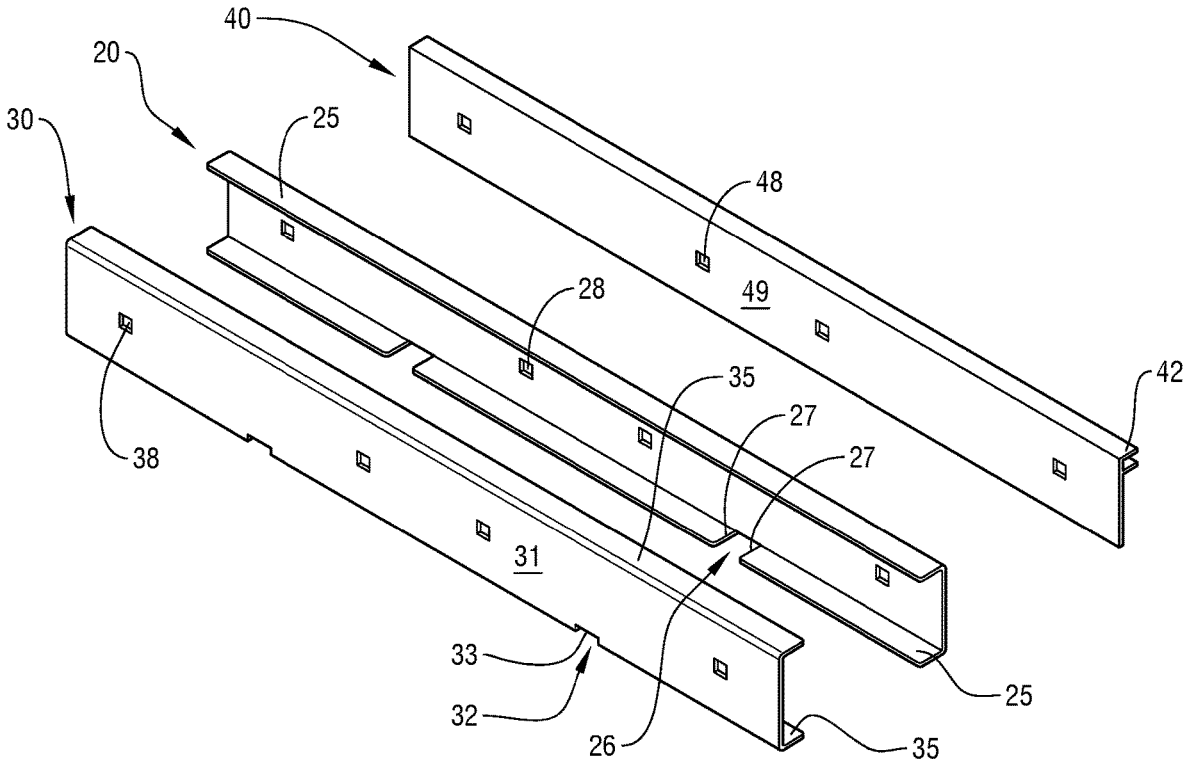
FIG. 12 is an exploded view of the two mount bracket portions and an aspect of the implement holder of the second embodiment of the present invention.

The implement holder 40 supports the channel 45 into which the rake/brush 50 is received, as seen in FIG. 11. The channel preferably runs substantially the length of the implement holder 40, but multiple channel portions that each extend a portion of the length of the implement holder 40 may optionally be used to hold the rake/brush 50. In the aspect shown in FIG. 11, the rake/brush 50 is removable from the implement holder 40 and is replaceable when worn. In another aspect, the rake/brush 50 is non-removable from the channel 45 of the implement holder 40, but, instead, is fixedly attached via a securing means, such as by glue or adhesives or by screws, bolts or other hardware. In another aspect, shown in the third embodiment of FIGS. 13-14, the implement holder 40 and the rake/brush 50 are formed integrally. In the aspects in which the rake/brush 50 is fixedly attached within the implement holder channel 45 or formed integrally with the implement holder 40, if the rake/brush 50 becomes worn and unusable, the joined implement holder 40 and rake/brush 50 combination can be removed and replaced.

The rake/brush 50 comprises a fill (projections 55) and a binding 53. In the first and second embodiments, the projections 55 comprise bristles, which are filaments that may be formed of synthetic materials or of metal, whereas in the third embodiment of FIGS. 13-14, the projections 55 comprise straight or curved metal tines, which have a width greater than the width of the bristles. Synthetic materials include man-made fibers including nylon, polyester, polypropylene, and the like. Metal bristles include both straight and twisted wire of stainless steel, high carbon steel, brass, or the like. Twisted or crimped nylon bristles are preferred due to the characteristics of the nylon material, which include high durability, high abrasion resistance, non-shedding, and excellent bend recovery. The trim may be flat, beveled, or off-set, but a flat trim is preferred. The trim length L9 (FIG. 6), the length of the exposed filament, may vary from 1 inches to 10 inches, but in a specific design aspect for a specific drop spreader is preferably 1 to 2 inches.

The binding 53 (FIGS. 6-7) secures or binds the bristles together. The binding 53 may be metal or a man-made material. Preferably the binding 53 is formed of metal and holds the upward ends of the projections 55 securely.

FIGS. 3-10, 12 illustrate the second exemplary embodiment of the particulate-incorporating attachment 10 of the present invention, which is similar to the first embodiment, but differs in at least that the proximal and distal bracket portions 20, 30 are C-shaped and that the angle between the channel 45 and the flat panel of the implement holder 40 varies in angle from the first embodiment.

FIG. 3 shows an exploded view of the proximal bracket portion 20, distal bracket portion 30 and implement holder 40. As in the first embodiment, the proximal bracket portion 20 includes a panel 21 and a lower flange 25, and the distal bracket portion 30 includes a panel 31 and an upper flange 35. In the second embodiment, the proximal bracket portion 20 further includes an upper flange 25, and the distal bracket portion 30 further includes a lower flange 35. When installed, the flanges 25, 35 of the proximal and distal bracket portions 20, 30 overlap. Specifically, the two upper flanges 25, 35 overlap, and the two lower flanges 25, 35 overlap. Therefore, the heights of the panels 21, 31 must differ sufficiently to allow this overlap. In an example shown in FIGS. 4-5, the height H1 (FIG. 4) of the distal bracket portion 30 is sufficiently greater than the height H2 (FIG. 5) of the proximal bracket portion 20 to permit the proximal bracket portion 20 to be positioned within the flanges 35 of the distal bracket portion 30. It will be apparent that the reverse (H2>H1) would also suitably enable the overlap.

Figure 10:
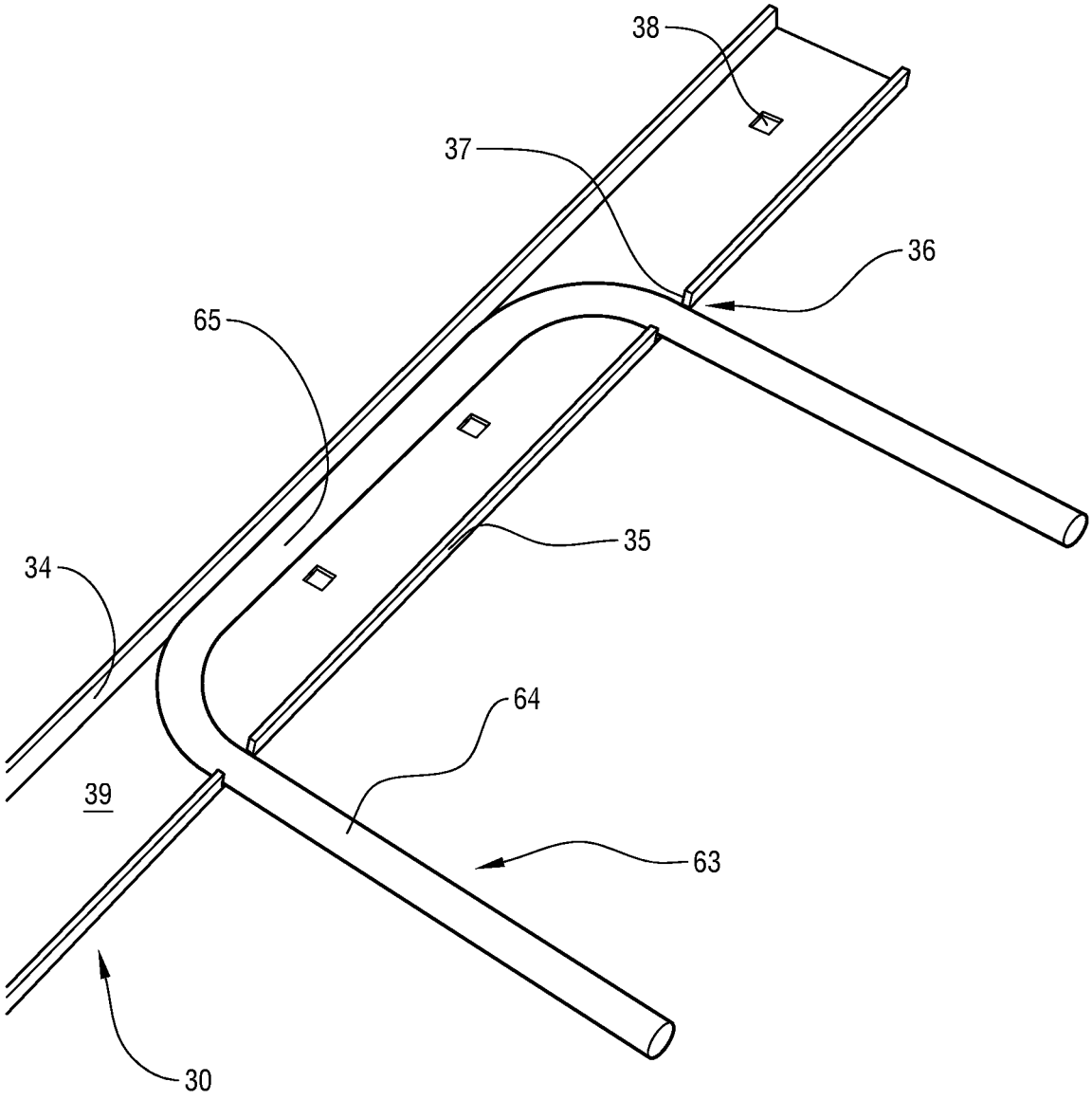
FIG. 10 is an inner perspective view of the bracket portion of the second embodiment of the particulate-incorporating attachment of the present invention with a portion of the spreader rest brace inserted into the inner portion of the bracket portion, which is an initial step of the installation of the two mount bracket portions over the rest brace to form the completed mount bracket.

As in the first embodiment, the distal bracket upper flange 35 is configured with a pair of notches 36 defined by notch edges 37, with the notches 36 sized and spaced to receive the rest brace extending arms 64, as seen in FIG. 10. In addition, due to the overlapping of the proximal bracket upper flange 25 with the distal bracket upper flange 35, the proximal bracket upper flange 25 comprises a pair of notches 26 defined by notch edges 27 that correspond to the pair of distal bracket upper flange notches 36 and that also receive the rest brace extending arms 64.

In one aspect of the invention, the distal bracket upper flange notch edges 37 may extend past the substantially ninety-degree bend that is created during fabrication of the bend between the upper flange 35 and the panel 31. The continuation of notch edges 37 past the bend and into the panel 31 portion creates a portion of the notch 36 that extends beyond the bend, notch extension 32 defined by notch edges 33, as seen in FIG. 3. Similarly, in the proximal bracket portion 20, the proximal bracket notches 26 may extend beyond the bend between the panel 21 and the upper flange 25 to create notch extensions within the panel 21. Notch extensions are not necessary for the invention, however, due to the imprecision of some of the bending techniques, the extension of the notch edges beyond the bend may provide some advantages to accommodate manufacturing irregularities. For example, if the metal material of the panel 31 is bent with a slightly deeper flange than the specifications stipulate, the inclusion of the notch extensions may facilitate insertion.

Figure 6:
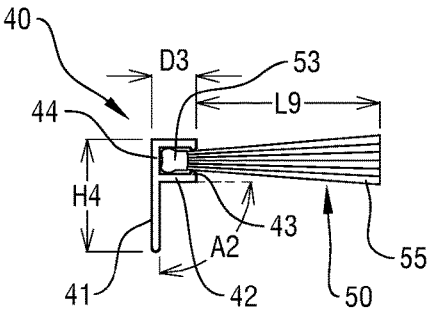
FIG. 6 is an end view of a rake/brush and a first aspect of the implement holder of the second embodiment of the present invention.
Figure 7:
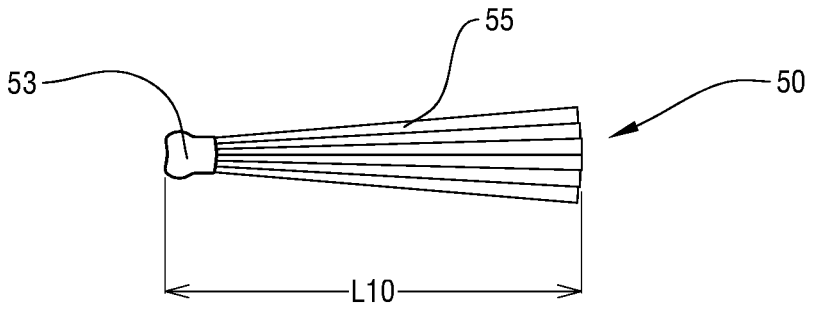
FIG. 7 is an end view of an aspect of the rake/brush of the present invention.

In the aspect of the invention seen in FIG. 6, the angle A2 between the exterior of the channel 45 and the flat plate 41 of the implement holder 40 is approximately ninety-degrees. For at least one conventional model of drop spreader, when angle A2 is ninety-degrees, the rake/brush 50 is positioned at the proper angle for raking or brushing the spreader-dispensed particulates. In other aspects of the invention, other measurements of angle A, may be suitable for other models, depending on factors such as the angle of the drop spreader rest brace 63. However, the size of angle A is typically in the range of 80 degrees to 190 degrees.

The rake/brush 50 of the second embodiment has a binding 53 suitable for carrying the bristles while the rake/brush 50 is being slid into the receiving channel 45, which is sized and configured to receive the binding 53, as seen in FIG. 11. The binding 53 is preferably a metal binding that may be thicker and more robust than the binding 53 in the aspect in which the binding 53 is permanently attached within the channel 45.

Figure 13:
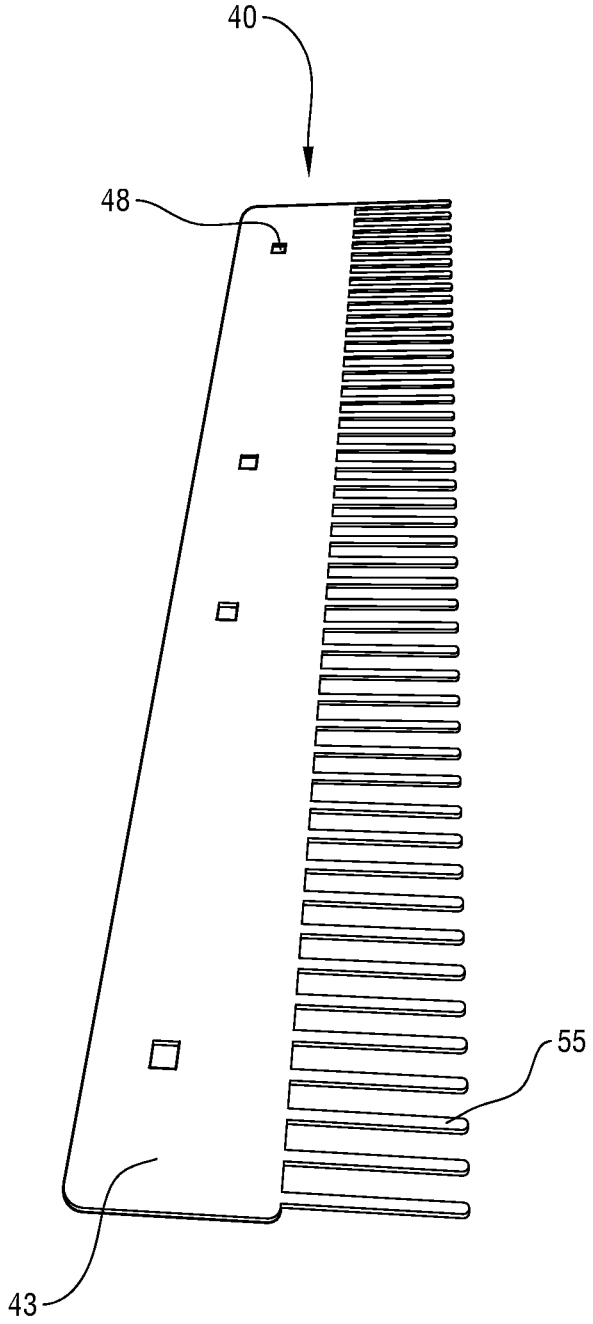
FIG. 13 is a perspective view of a first aspect of the third embodiment of the present invention, illustrating an implement holder formed integrally with a rake/brush with straight projections.
Figure 14:
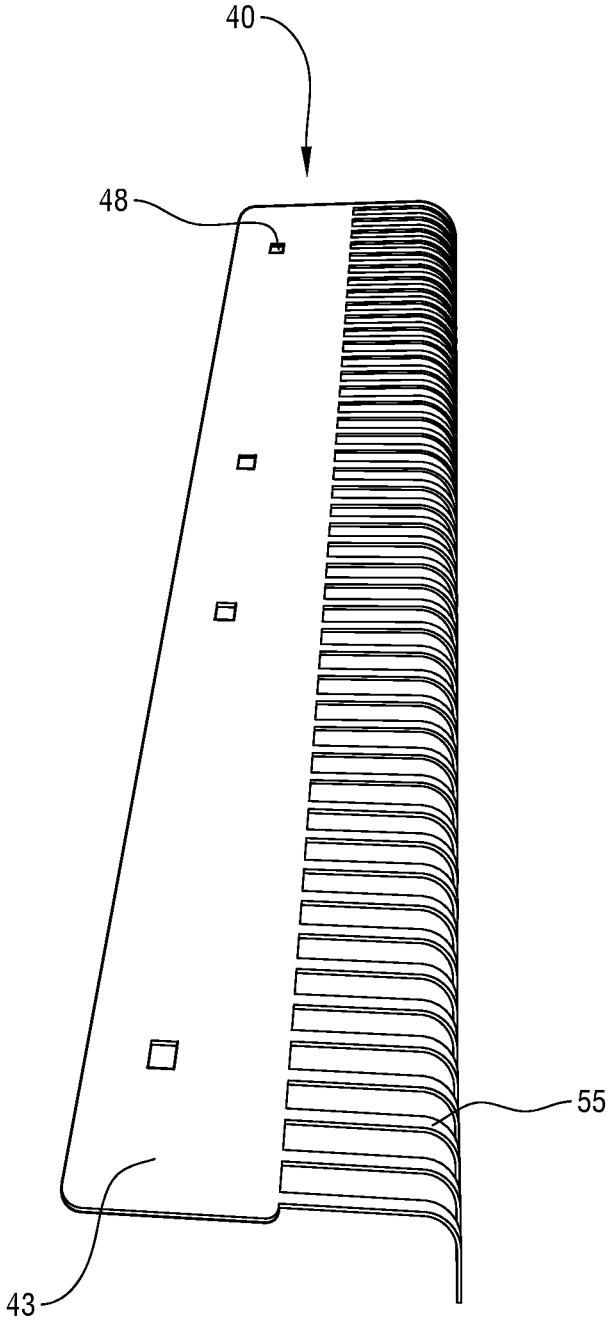
FIG. 14 is a perspective view of another aspect of the third embodiment of the present invention, illustrating an implement holder formed integrally with a rake/brush with curved projections.

In the third embodiment of FIGS. 13-14, additional aspects of the implement holder 40 and the rake/brush 50 (which may attach to the mounting bracket of the first, second, or fourth embodiments) are shown. In both FIGS. 13-14, the implement holder 40 is formed integrally with the rake/brush 50. In another aspect, shown in FIG. 13, the projections 55 are wider than the projections of FIGS. 1-12 and are straight. In another aspect, shown in FIG. 14, the projections 55 are wider than the projections of FIGS. 1-12, but are curved.

In the third embodiment, the implement holder 40 and rake/brush 50 may be formed from a single metal blank, with the projections 55 cut along a longitudinal side and with the holes 48 disposed within the opposing longitudinal side of the blank. Optionally, the longitudinal side including the projections 55 may be reinforced with a second material, such as another sheet of metal or a plastic. The width of the projections 55 of the third embodiment of FIGS. 13-14 may vary from 1/32 inch to 3/8 inch; the length of the projections 55 may vary from 1 to 5 inches.

In the fourth embodiment of FIGS. 15-19, the two-part bracket portion (along with the implement holder and rake/brush 50) is carried by a set of wheels 80. In an additional aspect, an optional shield 70 is provided to reduce the amount of particulate matter that is projected rearwardly toward the operator of the spreader or splattered onto the operator, thereby improving the user experience.

The wheels 80 are attached to the two-part mount bracket 15 in any suitable manner. An exemplary attachment mechanism is illustrated in FIGS. 15-19 in which one of the brackets 20, 30 has opposing closed ends or partially closed ends (end member 19), each of which is configured with a hole defined by hole edges 18. In the figures, the bracket 30 is shown as configured with the end members 19, but alternatively, bracket 20 may be configured to include the end members 19. The end member hole is configured to receive a wheel stud 85. The wheel stud 85 includes an end cap 81 attached at the end of a shaft 82. The end cap 81 may be only a metal portion of the stud 85 or may optionally incorporate an additional assembly (such as washers, spacers, or gaskets). The shaft 82 has a distal threaded portion 89. The shaft 82 extends from the end cap 81 to the end of the threaded portion 89. Gaskets, hole casings, spacers, and washers may be used to reinforce or cushion the interface of the stud 85 and the hole edges 18.

The wheel 80 has an outer tire (solid or air-filled) with an inner hub 83. The inner hub 83 has a centrally-located hub hole 84 that is sized to accommodate the shaft of wheel stud 85. The wheel stud 85 is inserted through the hub hole 84 and is sufficiently long enough that the threaded portion 89 extends beyond the hub hole 84 and through the hole on the end of the two-part mount bracket 15 to receive a nut 88. Because the end cap 81 is larger than the hub hole 84, it is maintained on the outward side of the hub 83.

Figure 18:
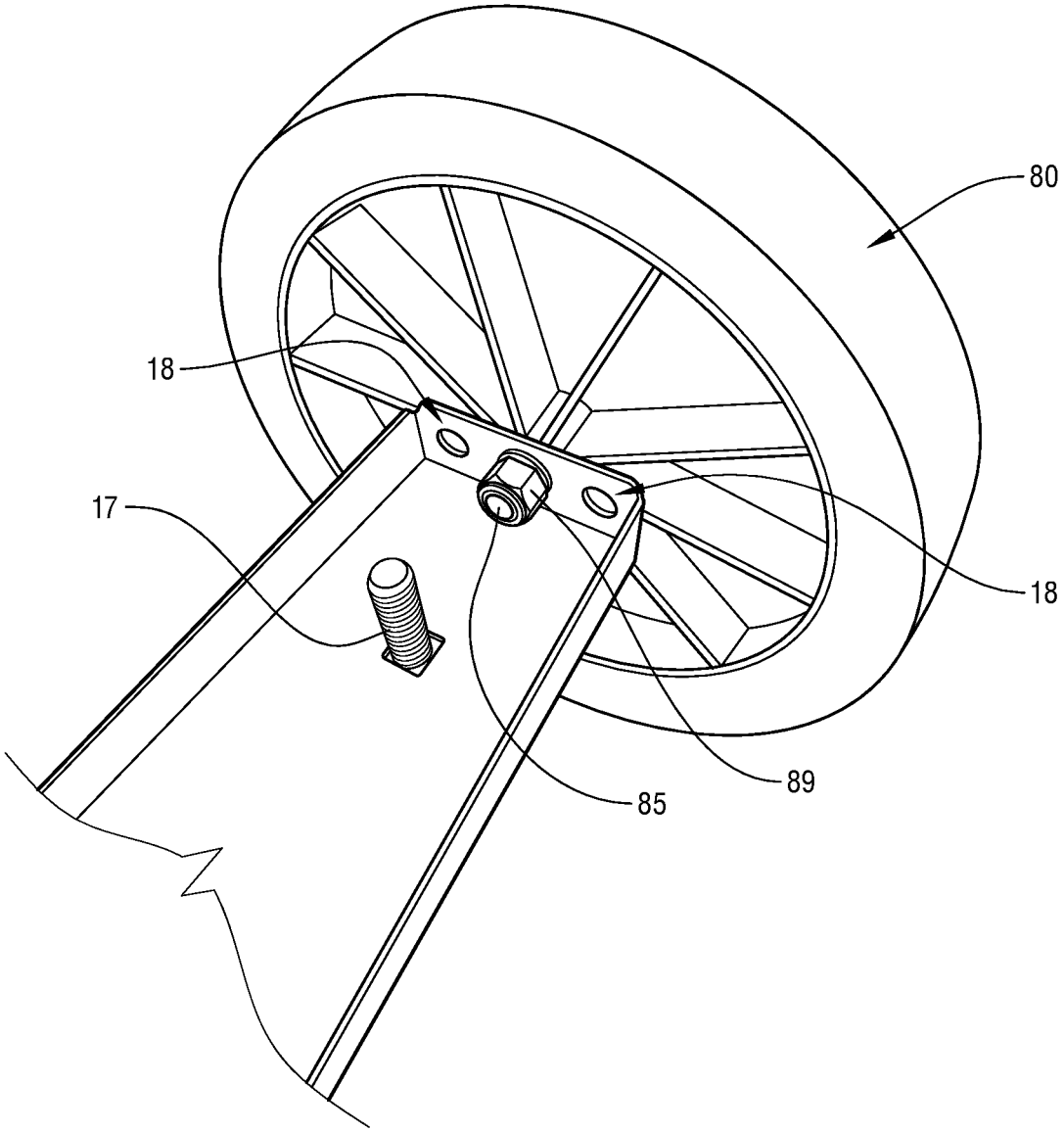
FIG. 18 is a perspective view of the wheeled particulate-incorporating attachment of the fourth embodiment of the present invention.

To provide adjustability, as can be seen in the aspect of FIG. 18, the end members of the two-part mount bracket 15 (which may be disposed on bracket 30 or, optionally, bracket 20) may be configured with multiple stud-receiving holes defined by multiple hole edges 18. Though typically the central stud-receiving hole may provide the desired height and angle of the wheels, the provision of multiple holes provides adjustability for the operator of the spreader attachment 10, allowing the wheels to be positioned higher or lower as needed. This aspect may allow the spreader attachment 10 to be used with a larger variety of models of spreaders 60.

Figure 15:
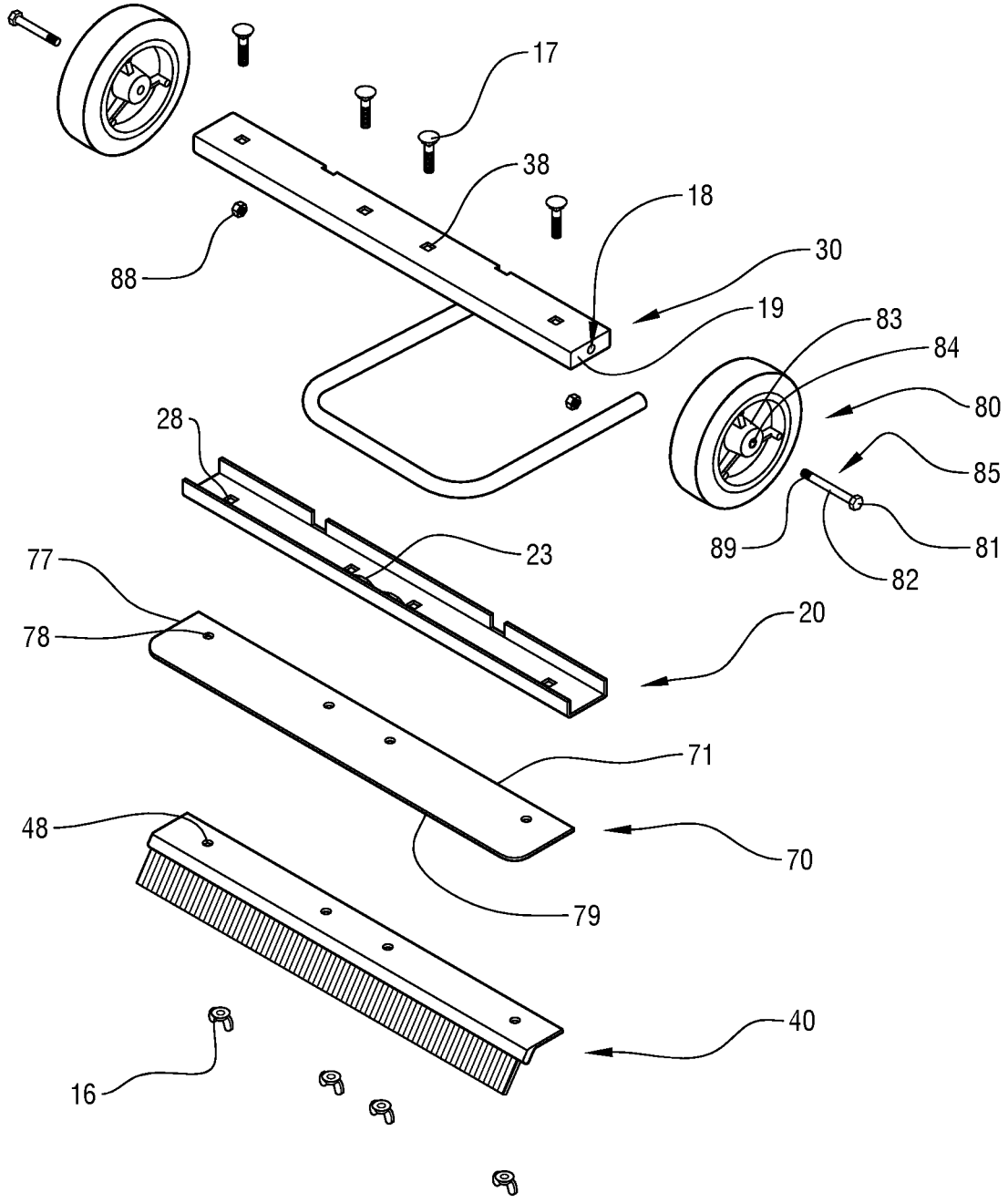
FIG. 15 is an exploded view of a fourth wheeled embodiment of the attachment of the present invention, which illustrates optional wheels and associated components and an optional shield.
Figure 17:
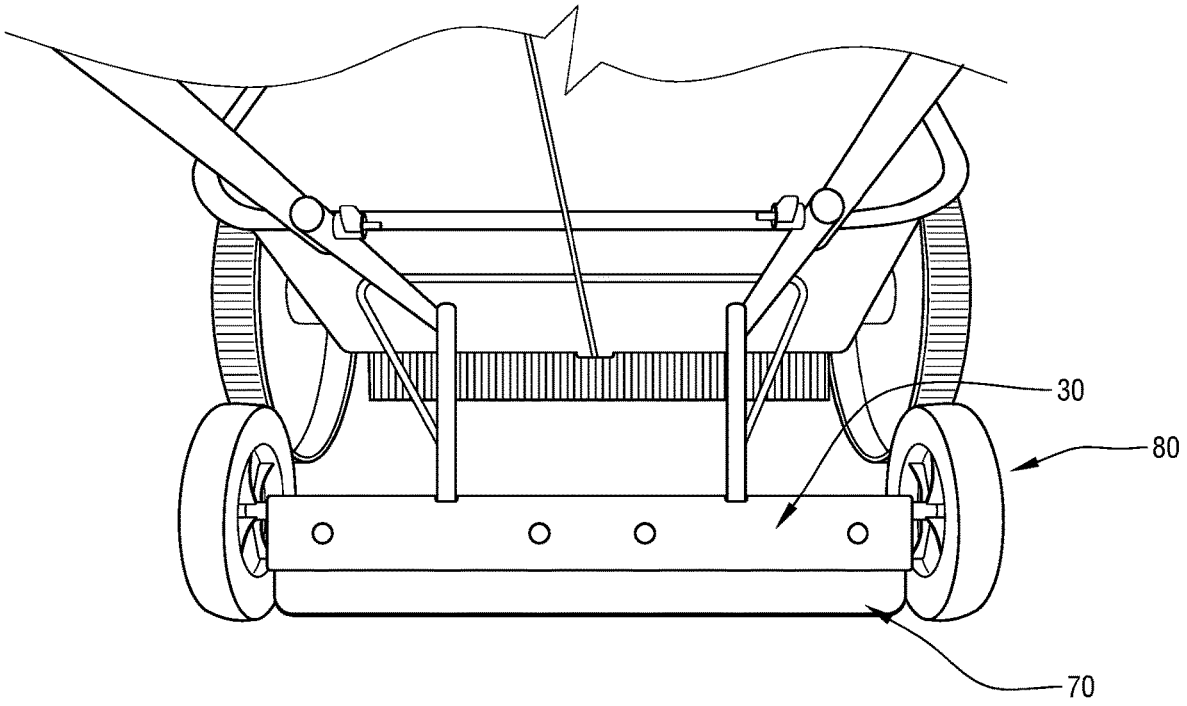
FIG. 17 is a top view of the fourth embodiment of the particulate-incorporating attachment of the present invention in its environment of use, which is attached to a manual drop spreader and which shows a shield and wheels.

In a further aspect of the invention, as seen in FIGS. 15 and 17, a shield 70 is provided to deflect any particulates that are slung backwardly toward the operator. The shield 70 attaches over the rake/brush 50. The shield 70 is substantially the length of the rake/brush 50, and it extends from front edge 79 to rear edge 71 a distance that is wider than the width of the brackets 20, 30. As seen in FIG. 15, the shield 70 may be positioned between the bracket 20 and the implement holder 40 and secured in this position when the brackets 20, 30 and implement holder 40 are attached together by bolts 17 and nuts 16. Thus, shield 70 is preferably configured with holes 78 that correspond to the holes 28, 38, 48 of bracket 20, bracket 30, and implement holder 40, respectively.

Figure 16:
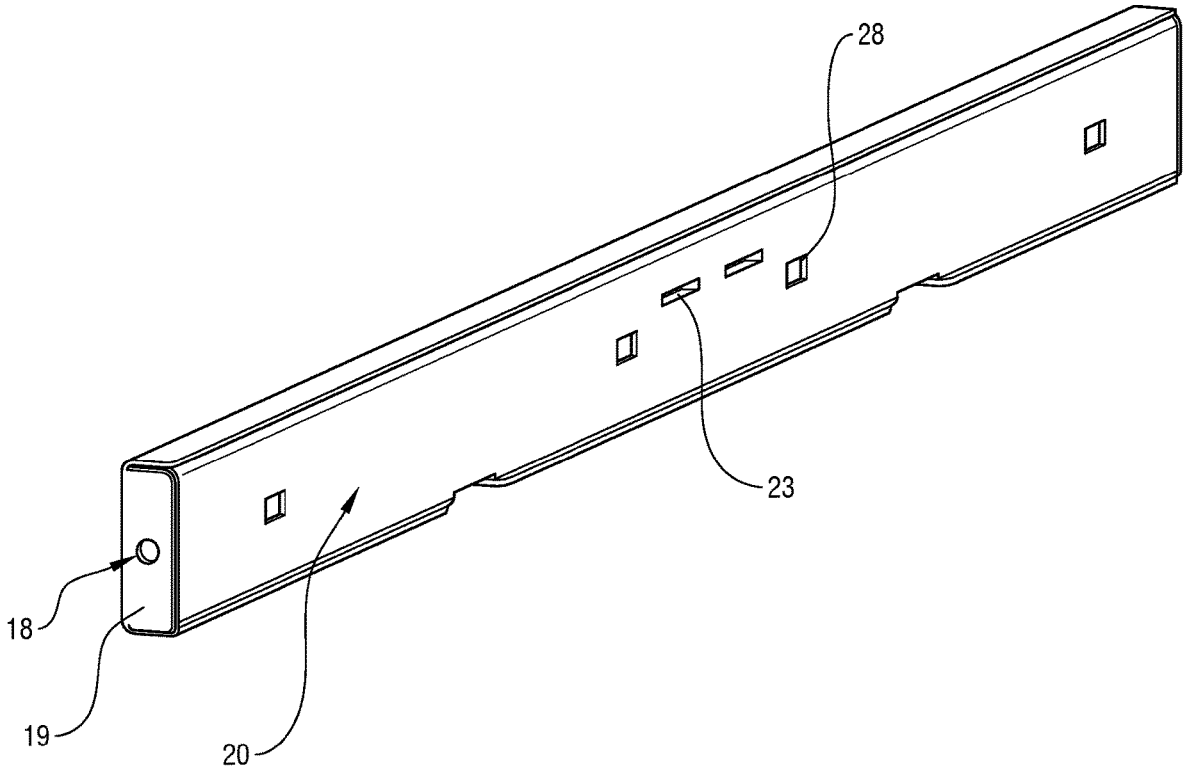
FIG. 16 is a perspective view of the two mount bracket portions particularly showing the bracket end member's wheel attachment and the alignment projections of the mount bracket of the fourth embodiment of the present invention.
Figure 19:
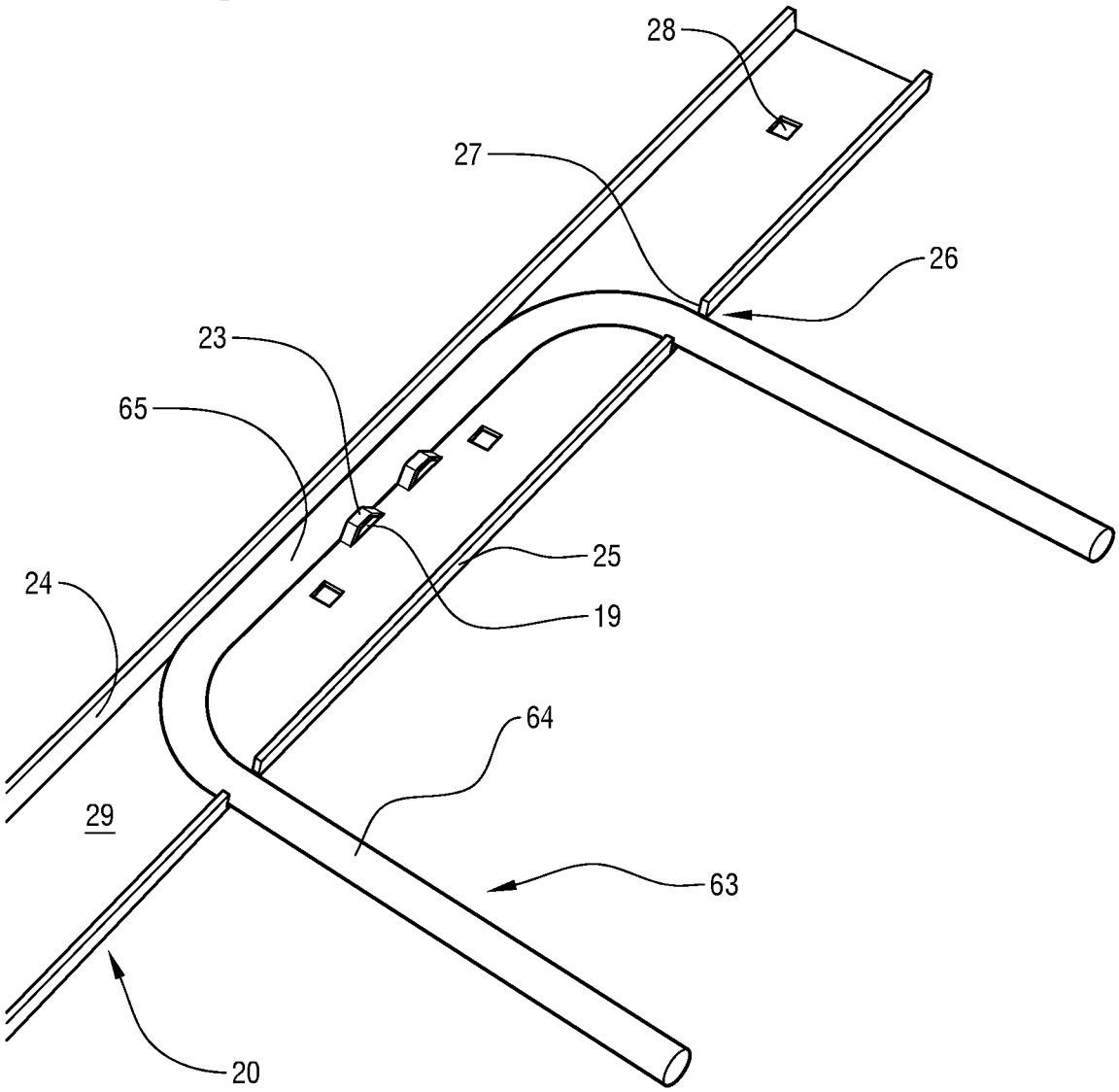
FIG. 19 is an inner perspective view of a bracket portion of the fourth embodiment of the particulate-incorporating attachment of the present invention with a portion of the spreader rest brace inserted into the inner portion of the bracket portion and held in place by alignment projections.

In another aspect of the invention, as seen in FIGS. 15-16, 19, alignment projections 23 may be provided. The alignment projections 23 extend inwardly beyond the planar inner face of wall 29 of bracket 20. The cross brace 65 of the rest brace 63 of the drop spreader 60 (when positioned into the notch 26 in the lower flange 25) fits between the upper flange 24 and the alignment projections 23, which assists a user in installing the spreader attachment 10 without help from an assistant. The alignment projections 23 may be bolts that project inwardly inside the planar wall 29, may be members attached to the inside of the planar wall 29, may be pressed from the metal of the planar wall 29 leaving a hole beneath the alignment projections 23 (such as the curved protrusions illustrated), or may be another type of projection that is suitable for holding the cross brace 65 in position during assembly.

To attach the particulate-incorporating attachment 10 to a conventional manually powered drop spreader 60, the spreader rest brace 63 is positioned within the interior of the distal bracket portion 30 against the inner surface 39 of the distal bracket portion 30, as seen in FIGS. 10, 19. Specifically, the right and left rest brace arms 64 are placed within the right and left notches 36 within the upper flange 35. In the case of the fourth embodiment, the alignment projections 23 frictionally hold the spreader rest brace 63 in position to facilitate installation by a single operator. The proximal bracket portion 20 is then brought parallel to the complementary distal bracket portion 30 with the set of proximal bracket holes 28 in alignment with the set of distal bracket holes 38. Additionally, in the second embodiment, the proximal bracket portion 20 is positioned with the right and left notches 26 (within the upper proximal bracket flange 25) aligned with the distal bracket flange notches 36. To complete the mount bracket 15, the proximal bracket portion 20 is then bolted to the distal bracket portion 30 with the rest cross bar 65 captured inside the space between the two mount bracket portions inside the completed bracket.

The implement holder 40 is attached to the exterior of proximal bracket rearward panel 21, by lining up implement holder holes 48 with the proximal bracket holes 22 (when separate bracket holes 22 are to be used, as in FIG. 3) or with proximal bracket holes 28 (when holes 48 are aligned with both holes 28 and 38, as in FIG. 12) and using bolts or other fasteners 12 for joining. (In the aspect in which the implement holder 40 is formed integrally with the proximal bracket portion 20, such as in FIGS. 13-14, this step is not needed.) In the aspects in which the rake/brush 50 is carried by, fixedly attached to, or formed integrally with the implement holder 40 (such as in FIGS. 13-14), this completes the assembly of the particulate-incorporating attachment 10.

In the aspect shown in FIG. 11 in which the rake/brush 50 is removable from the implement holder 40, the rake/brush 50 is then slid into the channel 45 to complete the assembly of the particulate-incorporating attachment 10.

After assembly of the particulate-incorporating attachment 10, the particulate-incorporating attachment 10 is supported at least by the contained segments (rest brace arms 64 and rest cross member 65) of the rest brace 63. The rest brace cross bar 65 is confined, clamped or otherwise constrained between the bracket portions 20, 30. In the embodiments without wheels, the particulate-incorporating attachment 10 is supported only by the rest brace 63. In the embodiment with wheels, the particulate-incorporating attachment 10 is supported both by the brace 63 and the wheels 80.

To use the particulate-incorporating attachment 10, the user raises the drop spreader 60 to the erect position, causing the ends of the projections 55 of the rake/brush 50 to thereby be positioned downwardly to touch the synthetic grass (or ground). With the attachment of the fourth embodiment, the wheels 80 will also touch the ground. The user pushes the drop spreader 60 forward, and particulates drop downwardly out of the drop spreader bottom opening 67 (FIG. 1) onto the synthetic grass (or ground). The rake/brush 50 follows a few inches behind the dispensed particulates and brushes, rakes, or otherwise incorporates the particulate into the synthetic grass. The dispensing step and incorporating step occur in one operation, taking no more time than the dispensing step alone requires. This significantly reduces the labor required compared to separately dispensing the particulates and then raking in the particulates.

Generally, in the fabrication of the particulate-incorporating attachment 10, each of the two bracket portions 20, 30 and the implement holder 40 will be formed of a sheet metal material. Any ductile metal material may be used, such as steel or aluminum. The thickness of the metal may be from 0.08 to 0.5 mm. Most preferably AISI 1020 cold drawn steel of between 0.09 and 0.20 mm may be used for the mount bracket portions 20, 30. Known metal bending techniques are used in the fabrication of the two bracket portions 20, 30 to form the flanges 25, 35, respectively, and in the fabrication of the opposing end members end member 19. Preferably extruded aluminum may be used for the implement holder 40, such as the extrudable aluminum alloy 6063-T5. Optionally, for some applications, the bracket portions 20, 30 and the implement holder 40 may be formed of a man-made material, such as a plastic.

The measurements of the various parts of the particulate-incorporating attachment 10 may vary depending on the model of drop spreader 60 to which it is to be attached and the use or application for which it will be used. However, preferred exemplary measurements are provided that are suitable for a specific design aspect when the particulate-incorporating attachment 10 is to be connected to a specific popular drop spreader model. The height H1 (FIG. 4) of the distal bracket portion 30 may be from 2 to 8 inches, but in the specific design aspect is preferably between 2 and 4 inches, and is most preferably 2.5-3 inches. The depth D1 (FIG. 5) of the flanges of the distal bracket portion 30 may be from 0.4 to 4 inches, but in the specific design aspect is preferably between 0.6 and 1 inches, and is most preferably 0.828 inches. The length L1 (FIG. 8) of the proximal and distal bracket portions 20, 30 may be from 15 inches up to 6 feet, but in the specific design aspect is preferably between 20 and 30 inches, and is most preferably 24 inches. The length L2 (FIG. 8) between the centers of the notches of the proximal and distal bracket portions 20, 30 may be from 8 to 20 inches, but in the specific design aspect is preferably between 10 and 14 inches, and is most preferably 11 inches. The distances L3, L4, L5 (FIG. 8) between the holes in the coordinating bracket portions 20, 30 are not critical, but may be in the range of from 3 to 16 inches. The length L6 (FIG. 9) of the notches 26, 36 in the proximal and distal flanges 20, 30, may be from 0.4 to 3 inches, but in the specific design aspect is preferably between 0.5 and 1.3 inches, and is most preferably 0.9 inches.

The height H2 (FIG. 5) of the proximal bracket portion 20 may be from 2 to 8 inches, but is preferably between 2.0 and 3.0 inches, but in the specific design aspect is preferably between 2 and 4 inches, and is most preferably 2.5-3 inches. The depth D2 (FIG. 5) of the flanges of the proximal bracket portion 20 may be from 0.4 to 4 inches, but in the specific design aspect is preferably between 0.6 and 1 inches, and is most preferably 0.828 inches.

The length L10 (FIG. 7) of the rake/brush 50 may be between 1.5 inches to 10.5 inches, but in the specific design aspect is preferably 2.0 to 3.5 inches, and is most preferably 3 inches.

The height H4 (FIG. 6) of the implement holder 40 may be from 1 up to the height H2 (FIG. 5) of the proximal bracket portion 20, but in the specific design aspect is preferably between 2.0 and 3.0 inches, and is most preferably 2.5-3 inches. The length of the implement holder 40 may be generally equal to the length of the rake/brush 50.

The detailed embodiments of the present invention disclosed herein are merely exemplary of the invention that may be embodied in various and alternative forms. The figures are not necessarily to scale, and some features may be exaggerated or minimized to show details of particular embodiments, features, or elements. Specific structural and functional details, dimensions, shapes, or implementations disclosed herein are not limiting but serve as a basis for the claims and for teaching a person of ordinary skill in the art the described and claimed features of embodiments of the present invention. Therefore, it is intended that the invention not be limited to the particular embodiments disclosed as the best mode contemplated for carrying out this invention, but that the invention will include all the embodiments falling within the scope of the appended claims.

What is claimed is:

1. An attachment for a drop spreader support rest, comprising:

a mount bracket comprising a proximal bracket portion connectable to a distal bracket portion that connect together over a segment of said drop spreader support rest;

an implement holder supported by said mount bracket;

a rake/brush supported by said implement holder;

wherein said rake/brush is removably attachable to said implement holder.

2. The attachment as recited in claim 1, wherein:

said mount bracket comprises a forward panel, a rearward panel, and two flanges; and one of said two flanges is configured with a right and left set of notch edges defining a right and left set of flange notches configured to receive said drop spreader support rest.

3. The attachment as recited in claim 1, wherein:

said distal bracket portion is C-shaped and comprises a distal bracket panel, a distal bracket upper flange disposed along one edge of said distal bracket panel, and a distal bracket lower flange disposed along the opposing edge of said distal bracket panel;

said proximal bracket portion is C-shaped and comprises a proximal bracket panel, a proximal bracket lower flange disposed along one edge of said proximal bracket panel, and comprises a proximal bracket upper flange disposed along the opposing edge of said proximal bracket panel;

said proximal bracket upper flange comprises two proximal bracket upper flange notch edges defining two proximal bracket upper flange notches; and each of said two proximal bracket upper flange notches accommodates a segment of said drop spreader support rest.

4. The attachment as recited in claim 1, wherein said implement holder is removably attachable to said mount bracket.

5. The attachment as recited in claim 1, wherein said implement holder is fixedly attached to said mount bracket.

6. The attachment as recited in claim 1, wherein said implement holder is formed integrally with said mount bracket.

7. The attachment as recited in claim 1, further comprising a shield connectable to said mount bracket, wherein said shield, when connected, extends behind said mount bracket.

8. The attachment as recited in claim 1, further comprising a set of wheels attached to said mount bracket.

9. The attachment, as recited in claim 1 wherein said mount bracket further comprises a first end member and a second end member; and wherein said attachment further comprises:

a first wheel attached to said first end member; and a second wheel attached to said second end member.

10. An attachment for a drop spreader support rest, said attachment comprising:

a mount bracket comprising a proximal bracket portion and a distal bracket portion; wherein said distal bracket portion comprises a distal forward panel and a distal upper flange; wherein said distal upper flange comprises right and left distal notch edges defining right and left distal bracket flange notches; wherein each of said right and left distal bracket flange notches accommodates a segment of said drop spreader support rest; and wherein said distal forward panel comprises a set of distal bracket hole edges defining a set of distal bracket holes;

an implement holder attachable to said mount bracket; and a rake/brush attachable to said implement holder.

11. The attachment, as recited in claim 10 wherein one of said proximal bracket portion or said distal bracket portion is configured with at least two alignment projections extending inwardly.

12. The attachment, as recited in claim 10 wherein:

said proximal bracket portion comprises a proximal rearward panel and a proximal lower flange;

said proximal rearward panel comprises a set of proximal bracket hole edges defining a set of proximal bracket holes;

said set of proximal bracket holes are disposed in a location corresponding to the location of said set of distal bracket holes; and said proximal bracket holes and said distal holes cooperate to receive a fastener to join said proximal bracket portion to said distal bracket portion around said segment of said drop spreader support rest.

13. The attachment, as recited in claim 10 wherein said implement holder is formed integrally with said proximal bracket portion.

14. The attachment, as recited in claim 10 wherein:

said implement holder comprises a flat panel and a channel extending longitudinally along the lower side of said flat panel; and said channel is sized and shaped to accommodate said rake/brush.

15. The attachment, as recited in claim 10 wherein said mount bracket further comprises a first end member and a second end member; and wherein said attachment further comprises:

a first wheel attached to said first end member; and a second wheel attached to said second end member.

16. The attachment, as recited in claim 10, further comprising a shield attachable to said mount bracket.

17. An attachment for a drop spreader support rest, said attachment comprising:

a mount bracket comprising a proximal bracket portion and a distal bracket portion; wherein said mount bracket comprises at least one flange configured with right and left notch edges defining right and left flange notches; wherein each of said right and left notches accommodates a segment of said drop spreader support rest; wherein said mount bracket comprises opposing first and second end members;

an implement holder attachable to said mount bracket;

a rake/brush attachable to said implement holder;

a first wheel attached to said first end member; and a second wheel attached to said second end member.

18. The attachment as recited in claim 17, further comprising a shield attachable to said mount bracket.

19. The attachment as recited in claim 17, wherein said mount bracket is configured with at least two inwardly-extending alignment projections.

* * * * *